US011933561B1

(12) United States Patent
Cameron

(10) Patent No.: US 11,933,561 B1
(45) Date of Patent: Mar. 19, 2024

(54) GUN SAFETY LOCK

(71) Applicant: Phoenix Safety and Rescue Products, Inc., Redmond, OR (US)

(72) Inventor: Robert W Cameron, Redmond, OR (US)

(73) Assignee: PHOENIX SAFETY AND RESCUE PRODUCTS INC., Redmond, OR (US)

( * ) Notice: Subject to any disclaimer, the term of this patent is extended or adjusted under 35 U.S.C. 154(b) by 0 days.

(21) Appl. No.: 18/373,944

(22) Filed: Sep. 27, 2023

Related U.S. Application Data

(60) Provisional application No. 63/413,451, filed on Oct. 5, 2022.

(51) Int. Cl.
*F41A 17/44* (2006.01)
*F41A 17/02* (2006.01)
*F41A 17/04* (2006.01)

(52) U.S. Cl.
CPC ..... *F41A 17/44* (2013.01); *F41A 17/02* (2013.01); *F41A 17/04* (2013.01)

(58) Field of Classification Search
CPC ..... F41A 17/00; F41A 17/04; F41A 17/02; F41A 17/44
See application file for complete search history.

(56) References Cited

U.S. PATENT DOCUMENTS 797,635 A * 8/1905 Telejszo ..... F16G 11/12 403/46
2,580,482 A * 1/1952 Stukenborg ..... F16G 11/12 411/218
2,878,044 A * 3/1959 Estes ..... F16G 11/12 403/46
3,368,297 A * 2/1968 Lentz ..... F41A 17/44 42/70.07
3,720,014 A * 3/1973 Goodrich ..... F41A 17/44 42/70.11
4,271,969 A * 6/1981 Gnesa ..... F41A 23/18 248/156
4,969,284 A * 11/1990 Healey ..... F41A 17/44 42/70.11
4,972,619 A * 11/1990 Eckert ..... F41A 23/16 89/37.04
4,999,940 A * 3/1991 Madden ..... F41A 17/44 42/70.11
5,044,106 A * 9/1991 Slocum ..... F41A 17/44 42/70.11
D341,072 S * 11/1993 Bryant ..... 42/70.11
5,271,174 A * 12/1993 Bentley ..... F41A 17/44 42/70.11
5,446,988 A * 9/1995 Frederick, Jr. ..... F41A 17/44 42/70.11
5,548,915 A * 8/1996 Szarmach ..... F41A 17/02 70/38 R (Continued)

*Primary Examiner* — Joshua E Freeman
(74) *Attorney, Agent, or Firm* — Roy L Anderson

(57) ABSTRACT

A gun safety lock uses a turnbuckle mechanism and a locking mechanism to lock a breach end of the turnbuckle mechanism in the breach of a gun and lock a barrel end of the turnbuckle mechanism in a barrel of the gun. The gun safety lock is removed from the gun by unlocking the locking mechanism to allow the turnbuckle mechanism to be rotated so that its breach and barrel ends can be removed from the gun.

12 Claims, 2 Drawing Sheets

(56) References Cited

U.S. PATENT DOCUMENTS

| | | | | |
|---|---|---|---|---|
| 6,382,002 | B1 * | 5/2002 | Chen | F41A 17/44 42/70.07 |
| 6,385,889 | B1 * | 5/2002 | Zaharek | F41A 17/44 42/70.07 |
| 11,320,225 | B1 * | 5/2022 | Fly | F41A 17/44 |
| 2002/0040544 | A1 * | 4/2002 | Muhlestein | F41A 23/06 42/94 |
| 2002/0092223 | A1 * | 7/2002 | Blomquist | F41A 17/44 42/70.11 |
| 2015/0052795 | A1 * | 2/2015 | Burke | F41C 23/04 42/71.01 |
| 2017/0191783 | A1 * | 7/2017 | Gutierrez | F16M 13/022 |
| 2019/0101355 | A1 * | 4/2019 | Hubbell | F41C 23/16 |
| 2022/0364811 | A1 * | 11/2022 | Fly | F41A 17/44 |

* cited by examiner

GUN SAFETY LOCK

CROSS-REFERENCE TO RELATED APPLICATIONS

This application is a non-provisional application which claims priority from U.S. Ser. No. 63/413,451, filed Oct. 5, 2022, the disclosure of which is specifically incorporated herein by reference.

BACKGROUND OF THE INVENTION

Gun safety locks are mandated by some jurisdictions and different locks have been manufactured and sold. One problem with gun safety locks is that they are not secure and offer little resistance. For example, some gun safety locks are simply a cable attached to a key lock. A problem with this type of lock is that the cable can easily be cut with a proper tool. Another problem with gun safety locks is that they can be too cumbersome; when this is the case, the lock may not be used or, if it is used, may take too long to remove it when access to the gun is required quickly.

The present invention seeks to solve a long-felt need for a simple, safe, and secure gun safety lock that can be secured and unsecured quickly.

SUMMARY OF THE INVENTION

The present invention is generally directed to a gun safety lock and its method of use in which a turnbuckle type of mechanism is used to secure and unsecure a breach end and a barrel end in a gun by rotating the frame of the turnbuckle to thereby adjust the tension of the two ends which are preferably configured with a coating, layer or part which prevents the ends from damaging either the breach or the barrel. It is especially preferred that a locking device, such as a combination padlock, is used to secure the gun safety lock in place, and the locking device is formed integral with the turnbuckle type of mechanism. When the combination lock is in the locked position, the frame of the turnbuckle cannot be rotated to adjust the tension for allowing removal of the gun safety lock from the gun. When the combination lock is in the unlocked position, the frame of the turnbuckle can be rotated to allow one of the two ends to be tensioned between an unlocked position and a locked position.

Accordingly, it is a primary object of the present invention to provide an improved gun safety lock which can be quickly and unsecured to a gun.

This and further objects and advantages will be apparent to those skilled in the art in connection with the drawings and the detailed description of the invention set forth below.

BRIEF DESCRIPTION OF THE DRAWINGS

FIGS. 2-4 illustrate a turnbuckle type of mechanism in accordance with the present invention, with FIG. 2 illustrating a turnbuckle body in cross section connected to a locking device which is shown generally, while FIGS. 3 and 4 illustrate, respectively, in cross section, the breach and barrel portions of the turnbuckle device.

DETAILED DESCRIPTION OF THE INVENTION

In accordance with the present invention, a gun safety lock is quickly secured and unsecured to a gun when a locking device is in an unlocked position, whereas the device cannot be altered when the combination lock is in a locked position.

The gun safety lock utilizes a turnbuckle type of mechanism to snugly secure its two ends to the breach and the barrel of a gun, so that the gun cannot be loaded or fired when the gun safety lock is locked in place, and it is especially well-suited for use with handguns or pistols in which one size of a gun safety lock can fit many different types, makes and calibers of handguns or pistols. The present invention can also be utilized with rifles and shotguns, in which case different lengths of the gun safety lock can be used to accommodate different lengths of barrels and sizes of guns.

In accordance with an especially preferred embodiment of the present invention, a gun safety lock 1 utilizes a turnbuckle type of mechanism 10 which works by adjusting tension between its two ends by rotating the frame, which causes both of its ends to be screwed in or out simultaneously (although it is less desirable, the turnbuckle type of mechanism could be altered so that rotation of its frame only causes one of its ends to be screwed in or out and still be within the scope of the present invention). In a secured, closed, position, the two ends fit snugly in, respectively, the breach and barrel of the gun, whereas in an open position, the two ends can be removed from the breach and barrel of the gun. As noted in Wikipedia, under turnbuckle (en.wikipedia.org/wiki/Turnbuckle), the disclosure of which is specifically incorporated herein by reference, a turnbuckle normally has two threaded bolts, one screwed into each end of a small metal frame, one with a left-hand thread and the other with a right-hand thread. Tension can be adjusted by rotating the frame, which causes both bolts to be screwed in or out simultaneously.

Figure 1:
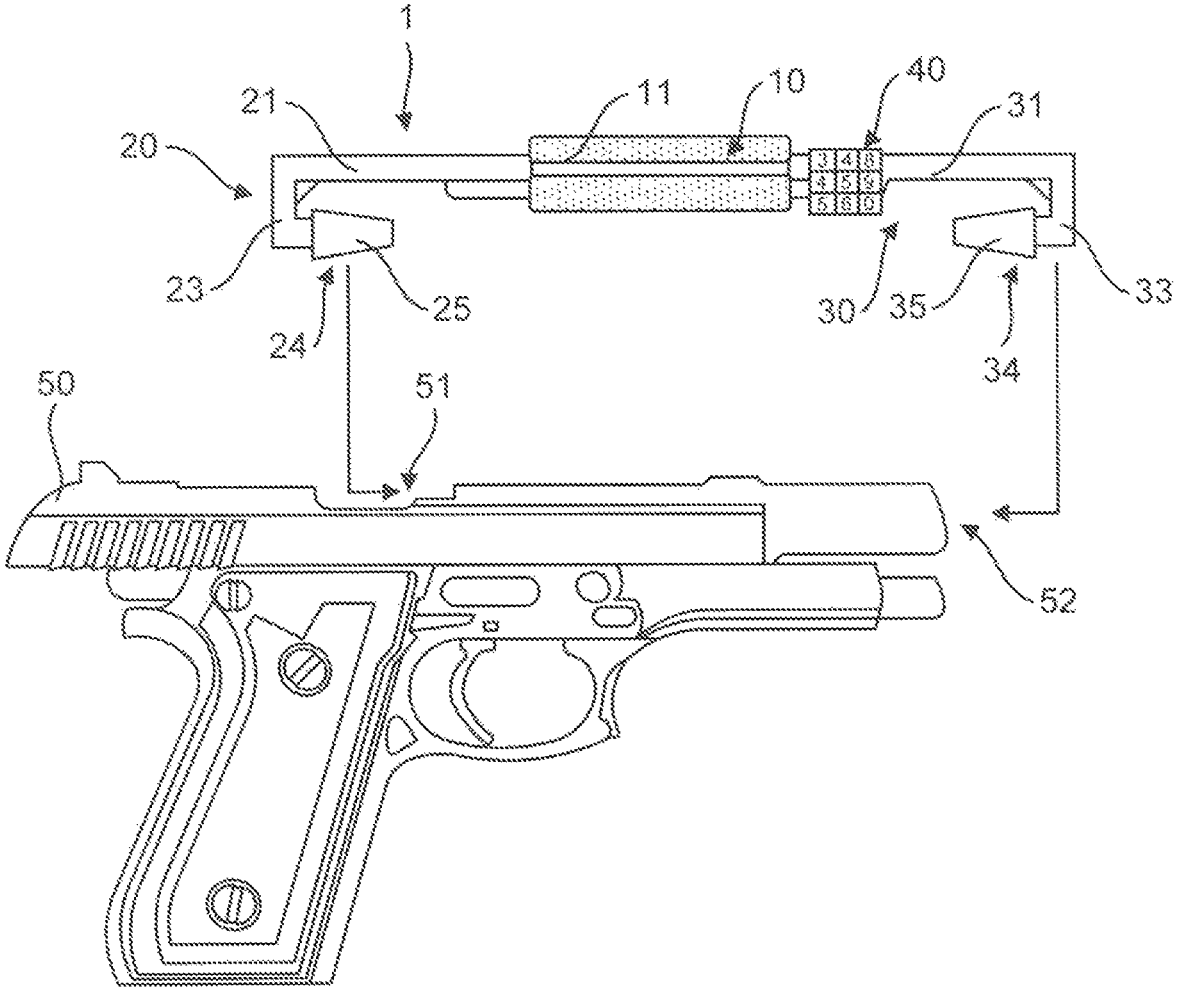
FIG. 1 illustrates a gun safety lock in accordance with the present invention when it is used with a pistol.
Figure 2:
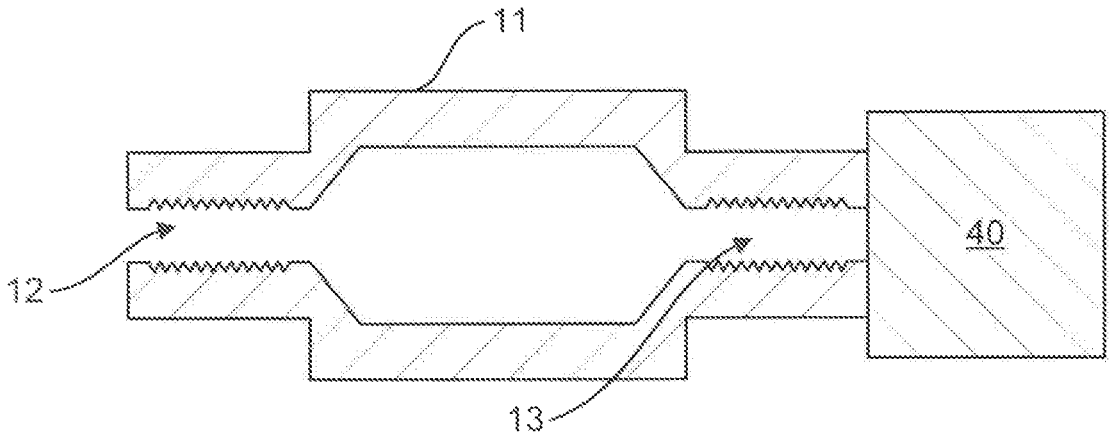
Figure 3:
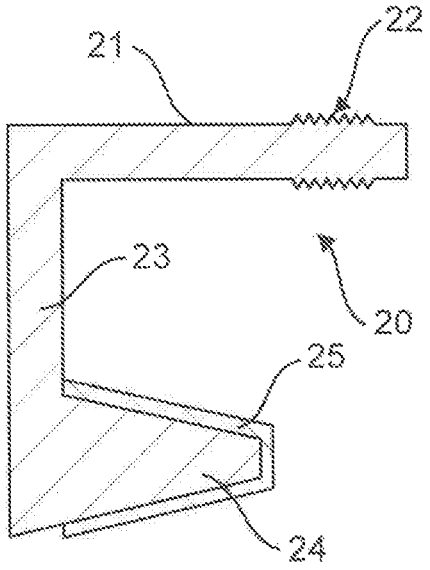
Figure 4:
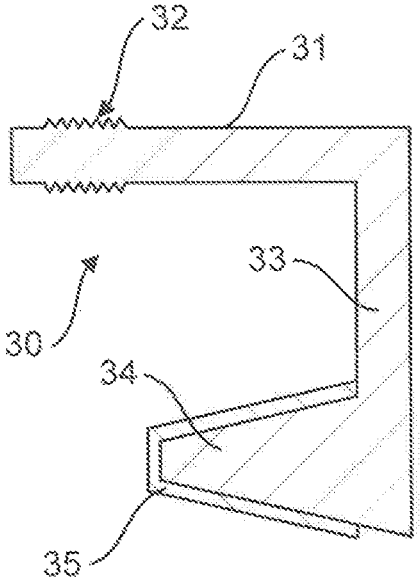

In a preferred embodiment of the present invention, as illustrated in FIG. 2, a turnbuckle mechanism 10 has a body 11, a breach portion 20 and a barrel portion 30. Body 11 has two internal screw threads 12 and 13 used to connect two threaded rods 21 and 31, respectively, one configured with a left-hand thread and the other with a right-hand thread. Threaded rod 21 has threads 22 and is configured with a breach arm 23 in a generally u-shape configuration which ends with a breach end 24 that is configured so that it can be placed into a breach 51 of a gun 50 (as is generally illustrated in FIG. 1) and, in an especially preferred embodiment, has a frustoconical shape configured to accommodate different sized breaches of different guns. Threaded rod 31 has threads 32 and is configured with a barrel arm 33 in a generally u-shape configuration which ends with a barrel end 34 that is configured so that it can be placed into a barrel 52 of a gun 50 (as is generally illustrated in FIG. 1) and, in an especially preferred embodiment, has a frustoconical shape configured to accommodate different sized barrels of different guns. It is especially preferred that body 11, threaded rods 21 and 31, threads 22 and 32, breach arm 23 and barrel arm 33, and breach end 24 and barrel end 34 be comprised of metal (e.g., stainless steel) or other strong and rigid composites, or case-hardened metals, so that the turnbuckle mechanism cannot easily be breached or cut. Breach end 24 and barrel end 34 are preferably configured with breach and barrel protective elements 25 and 35, respectively, which are configured to prevent metal to metal contact and damage to either breach 51 or barrel 52. Protective elements 25 and 35 can be a coating, a molded part or a part slipped over breach end 24 and barrel end 34 and can be fabricated, for example, from a polymer such as polyurethane, silicone, EPDM (ethylene propylene diene terpolymer), neoprene and natural rubber.

In accordance with the present invention, a locking device 40 is used to secure turnbuckle mechanism 10 from removing breach end 24 from breach 51 and barrel end 34 from barrel 52 when the locking device is in a locked position. In one especially preferred embodiment, locking device 40 is a combination lock, as is illustrated generally in FIG. 1. As noted in Wikipedia at https://en.wikipedia.org/wiki/Combination_lock, the disclosure of which is specifically incorporated herein by reference, a combination lock is a type of locking device in which a sequence of symbols, usually numbers, is used to open the lock, and some designs of such locks include multiple-dial locks, single-dial locks and rotary locks. In another especially preferred embodiment, locking device 40 is a key lock affixed to body 11 which allows movement of threaded rod 21 or 31 when it is in an unlocked position but prevents such movement when it is in a locked position. In one especially preferred embodiment, the locking device can be a multi cylinder lock. Additional locking devices, such as electronic or biometric locking devices, can also be used.

It is also especially preferred, whatever locking device is used, that the locking device itself be protected with metal (e.g., stainless steel) or other strong and rigid composites, or case-hardened metals, so that the locking device cannot easily be breached or cut, and it is especially preferred that locking device be made integral with turnbuckle mechanism 10, as is illustrated in FIG. 1. Accordingly, for example, locking device 40 can be made integral with, and be a part of, body 11, threaded rod 21 or threaded rod 31.

It should be noted that locks can eventually be figured out, or picked, but such devices provide sufficient security to prevent immediate use of the gun in most circumstances, such as when it might be acquired by a criminal element in a home invasion type of scenario, thus preventing easy use of the gun against its owner, while still providing sufficient security to guard against accidental unlocking by juveniles and the like, which is a problem with some of the flimsier gun locks which have been placed into the stream of commerce. Also, as opposed to trigger locks, the present invention helps to prevent against accidental discharge of a loaded gun. Moreover, when a safety lock in accordance with the present invention is made of a secure turnbuckle mechanism that cannot easily be cut, and locking device 40 is made integral therewith, the result is an improved, more secure, yet readily usable gun safety lock which can save lives, and one which can be used in many different makes and types of guns, rather than being designed solely for use with a particular gun.

While the invention has been described herein with reference to certain preferred embodiments, those embodiments have been presented by way of example only, and not to limit the scope of the invention. Additional embodiments and further modifications are also possible in alternative embodiments that will be obvious to those skilled in the art having the benefit of this detailed description.

Accordingly, still further changes and modifications in the actual concepts described herein can readily be made without departing from the spirit and scope of the disclosed inventions.

What is claimed is:

1. A gun safety lock which prevents a gun from being fired when it is in a locked position, comprising:

a turnbuckle mechanism comprised of a frame, a breach portion, and a barrel portion; and a locking device which can be locked in the locked position or unlocked in an unlocked position;

wherein the breach portion is configured with a breach end configured to fit into a breach of the gun in the locked position;

wherein the barrel portion is configured with a barrel end configured to fit into a barrel of the gun in the locked position;

wherein the breach portion is held locked in the frame with its breach end locked in the breach in the locked position while the barrel portion is held locked in the frame with its barrel end locked in the barrel in the locked position; and wherein both the breach end can be removed from the breach and the barrel end can be removed from the barrel by rotation of the turnbuckle mechanism once the locking device is changed from the locked position to the unlocked position.

2. The gun safety lock of claim 1, wherein the breach end is further comprised of a breach protective element.

3. The gun safety lock of claim 2, wherein the breach end is comprised of a frustoconical shape configured to accommodate a plurality of different sized breaches.

4. The gun safety lock of claim 1, wherein the barrel end is further comprised of a barrel protective element.

5. The gun safety lock of claim 1, wherein the locking device is comprised of a combination lock.

6. The gun safety lock of claim 1, wherein the locking device is comprised of a key lock.

7. The gun safety lock of claim 1, wherein the gun safety lock is configured for use with a handgun.

8. The gun safety lock of claim 7, wherein the breach end is configured for use with a plurality of handguns of different calibers.

9. The gun safety lock of claim 7, wherein the locking device is integral the turnbuckle mechanism.

10. The gun safety lock of claim 7, wherein the locking device is integral the turnbuckle mechanism.

11. A method for preventing a gun from being fired when a gun safety lock is in a locked position, comprising the steps of:

inserting a breach end of a breach portion of a turnbuckle mechanism into a breach of the gun and inserting a barrel end of a barrel portion of the turnbuckle mechanism into a barrel of the gun;

rotating the turnbuckle mechanism to cause the breach end to fit snugly into the breach of the gun and the barrel portion to fit snugly into the barrel portion of the gun; and locking the turnbuckle mechanism so that a frame of the turnbuckle cannot be rotated so as to remove either the breach end from the breach or the barrel end from the barrel.

12. The method of claim 6, comprising the further steps of:

unlocking the locking mechanism; and rotating the turnbuckle frame so that the breach end can be removed from the breach and the barrel end can be removed from the barrel.

* * * * *